US005150485A

United States Patent [19]

Maguire

[11] Patent Number: 5,150,485

[45] Date of Patent: Sep. 29, 1992

[54] BEACH BLANKET ANCHOR APPARATUS

[76] Inventor: Sean P. Maguire, 26 Barbie Dr., Rochester, N.Y. 14626

[21] Appl. No.: 785,686

[22] Filed: Oct. 31, 1991

[51] Int. Cl.[5] ..... A47G 9/06

[52] U.S. Cl. ..... 5/417; 5/420; 52/3

[58] Field of Search ..... 5/414, 416–420; 24/510; 52/3; 135/108, 114, 116, 117, 120

[56] References Cited

U.S. PATENT DOCUMENTS

| | | | |
|---|---|---|---|
| 2,554,688 | 5/1951 | Vollweiler | 135/114 X |
| 2,840,092 | 6/1958 | Hill | 5/417 X |
| 2,939,468 | 6/1960 | Boyce | 5/417 X |
| 3,241,202 | 3/1966 | Knouft | 5/417 X |
| 3,935,653 | 2/1976 | Klein | 5/417 X |
| 4,580,372 | 4/1986 | Oshora | 52/3 |
| 4,681,195 | 7/1987 | Traham et al. | 5/418 X |
| 4,750,508 | 6/1988 | Tatoian | 135/118 X |
| 4,782,084 | 2/1988 | Keserovich et al. | 5/417 |
| 4,914,767 | 4/1990 | Balicki et al. | 5/419 |
| 4,927,118 | 5/1990 | Picrorazio | 5/417 X |
| 5,022,107 | 6/1991 | Knotts | 5/420 X |

*Primary Examiner*—Michael F. Trettel
*Attorney, Agent, or Firm*—Hugh E. Smith

[57] ABSTRACT

A beach blanket flexible web includes an anchor member mounted for selective securement adjacent each corner of the web, to include a support base and a support base floor, with a clamping plate arranged for pivotal and biased engagement relative to the floor to secure an associated corner of the blanket web thereto. The base includes an externally threaded upper end oriented at an acute angle relative to the base floor, with a removable cap including a hollow cavity and a leverage appendage directed laterally of the cap and orthogonally relative to the hinge to receive a ballast weight therewithin. The invention further is arranged to include telescoping members mounted to each leveraged appendage portion of the cap for receiving a sun screen blanket to an upper terminal end thereof, wherein each extension leg is arranged to receive an extension leg cap at an upper terminal end thereof for mounting the sun screen web relative to the extension leg. A housing is arranged for mounting to a pair of the anchor members for supporting expansion storage components of the organization.

6 Claims, 4 Drawing Sheets

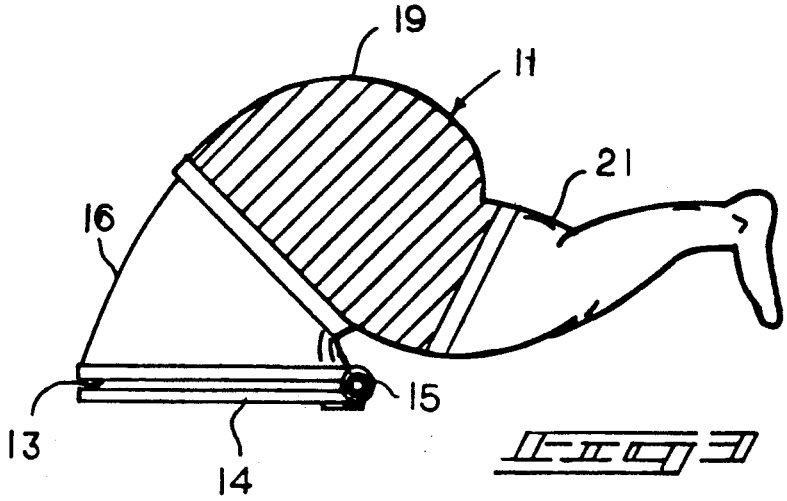
FIG 3
FIG 4
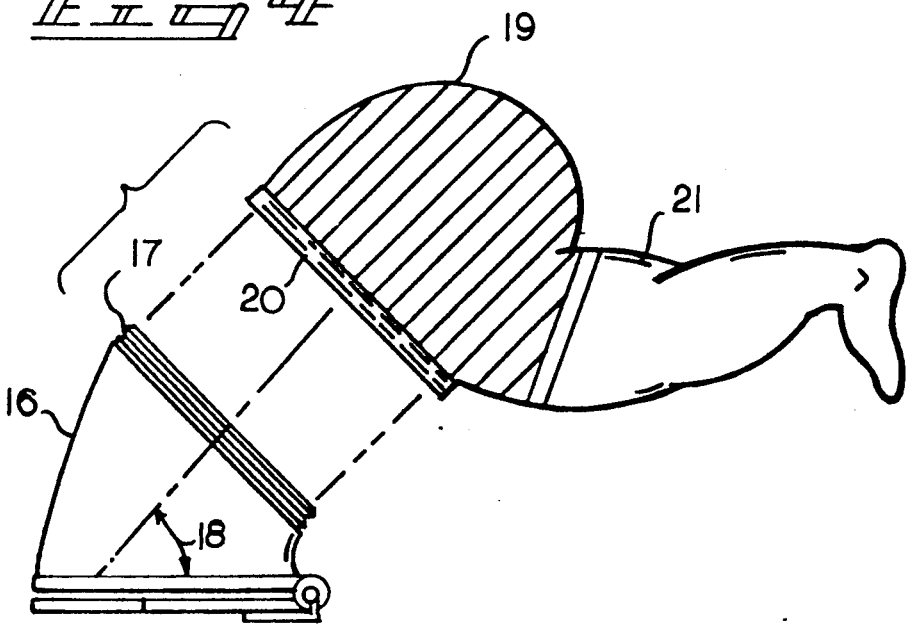

BEACH BLANKET ANCHOR APPARATUS

BACKGROUND OF THE INVENTION

1. Field of the Invention

The field of invention relates to beach apparatus, and more particularly pertains to a new and improved beach blanket anchor apparatus wherein the same is arranged for the positioning and mounting of beach blanket structure relative to a beach surface.

2. Description of the Prior Art

Beach blankets and the like are typically anchored by positioning various convenient items thereon such as sandals, sandwich bags, and the like to anchor the structure relative to an associated beach organization. Prior art apparatus has been utilized to anchor a beach blanket structure and is exemplified in U.S. Pat. No. 4,699,165 to Barzana wherein a stake includes a resilient loop to secure a beach blanket web thereto that provides for a projection of various corners that may impart injury in their use.

U.S. Pat. No. 4,654,906 to Roberts sets forth a beach blanket that is formed with pockets for receiving sand for positioning the beach blanket relative to a beach surface.

U.S. Pat. No. 4,634,618 to Greer sets forth a towel formed with a weighted perimeter to anchor the towel structure to a beach surface.

U.S. Pat. No. 4,709,430 to Nicoll sets forth a further example of a beach blanket formed with a weighted perimeter.

As such, it may be appreciated that there continues to be a need for a new and improved beach blanket anchor apparatus as set forth by the instant invention which addresses both the problems of ease of use as well as effectiveness in construction in providing anchoring structure conveniently mounted to a beach blanket web and in this respect, the present invention substantially fulfills this need.

SUMMARY OF THE INVENTION

In view of the foregoing disadvantages inherent in the known types of beach blanket anchor apparatus now present in the prior art, the present invention provides a beach blanket anchor apparatus wherein the same utilizes clip-on members mounted adjacent each corner portion of a beach blanket web permitting mounting of ballast within each anchor for securement thereof to a beach surface. As such, the general purpose of the present invention, which will be described subsequently in greater detail, is to provide a new and improved beach blanket apparatus which has all the advantages of the prior art beach blanket apparatus and none of the disadvantages.

To attain this, the present invention provides a beach blanket flexible web including an anchor member mounted for selective securement adjacent each corner of the web, to include a support base and a support base floor, with a clamping plate arranged for pivotal and biased engagement relative to the floor to secure an associated corner of the blanket web thereto. The base includes an externally threaded upper end oriented at an acute angle relative to the base floor, with a removable cap including a hollow cavity and a leverage appendage directed laterally of the cap and orthogonally relative to the hinge to receive a ballast weight therewithin. The invention further is arranged to include telescoping members mounted to each leveraged appendage portion of the cap for receiving a sun screen blanket to an upper terminal end thereof, wherein each extension leg is arranged to receive an extension leg cap at an upper terminal end thereof for mounting the sun screen web relative to the extension leg. A housing is arranged for mounting to a pair of the anchor members for supporting expansion storage components of the organization.

My invention resides not in any one of these features per se, but rather in the particular combination of all of them herein disclosed and claimed and it is distinguished from the prior art in this particular combination of all of its structures for the functions specified.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto. Those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved beach blanket anchor apparatus which has all the advantages of the prior art beach blanket anchor apparatus and none of the disadvantages.

It is another object of the present invention to provide a new and improved beach blanket anchor apparatus which may be easily and efficiently manufactured and marketed.

It is a further object of the present invention to provide a new and improved beach blanket anchor apparatus which is of a durable and reliable construction.

An even further object of the present invention is to provide a new and improved beach blanket anchor apparatus which is susceptible of a low cost of manufacture with regard to both materials and labor, and which accordingly is then susceptible of low prices of sale to the consuming public, thereby making such beach blanket anchor apparatus economically available to the buying public.

Still yet another object of the present invention is to provide a new and improved beach blanket anchor apparatus which provides in the apparatuses and methods of the prior art some of the advantages thereof, while simultaneously overcoming some of the disadvantages normally associated therewith.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 3 is an orthographic side view of the beach blanket anchor.

FIG. 4 is an exploded illustration of the beach blanket anchor illustrating the cap portion securable to the base.

DESCRIPTION OF THE PREFERRED EMBODIMENT

Figure 1:
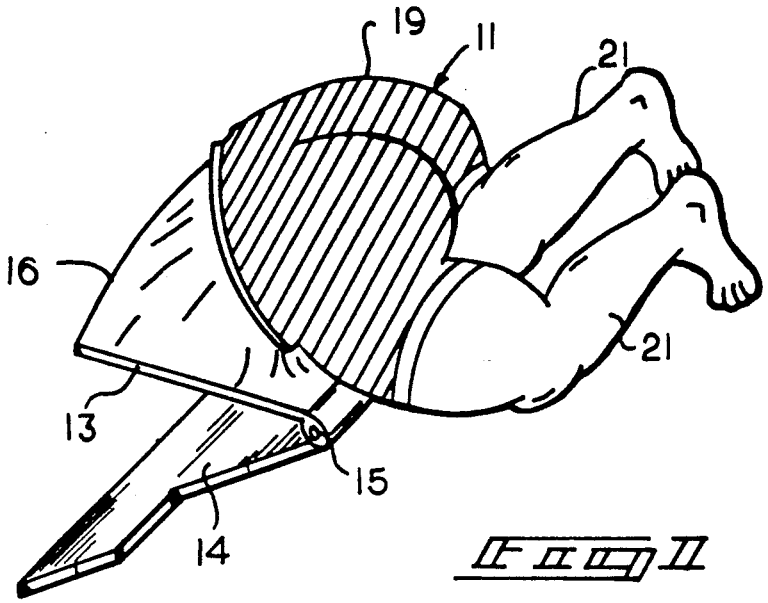
FIG. 1 is an isometric illustration of an anchor member utilized by the invention.

With reference now to the drawings, and in particular to FIGS. 1 to 7 thereof, a new and improved beach blanket anchor apparatus embodying the principles and concepts of the present invention and generally designated by the reference numeral 10 will be described.

Figure 2:
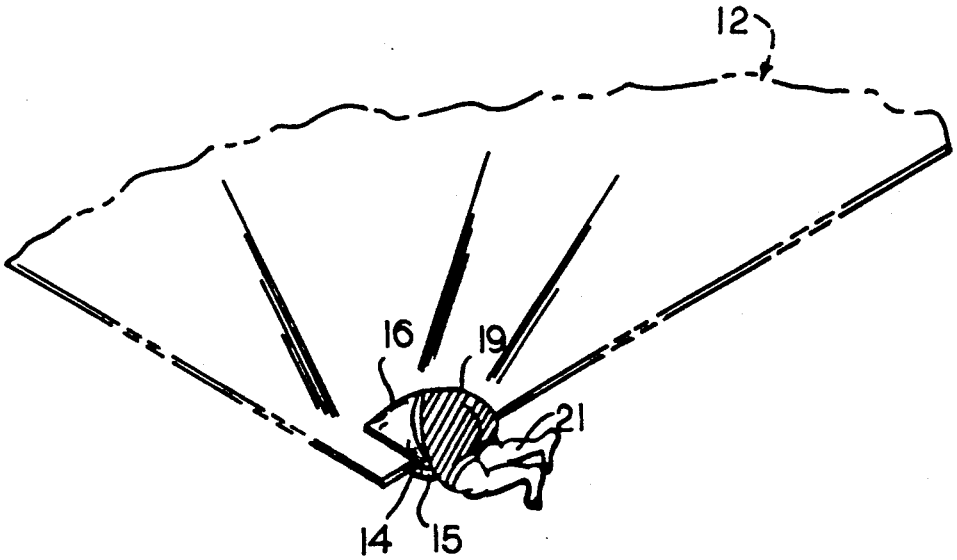
FIG. 2 is an isometric illustration of the anchor member mounted to an associated beach blanket web.

More specifically, the beach blanket anchor apparatus 10 of the instant invention essentially comprises an anchor member 11, of a type such as illustrated in the FIGS. 1 and 2, for securement to each corner, in a plurality of pairs to secure a rectilinear flexible blanket web 12 to an underlying beach surface. The anchor member 11 includes a planar base floor 13 with a cooperating clamp plate 14 coextensively with the base floor 13, including a clamp plate spring hinge 15 to bias the clamp plate 14 into contiguous engagement with the planar base floor 13 to permit securement of and reception of the blanket web 12 between the clamp plate 14 and the planar base floor 13. The base floor 13 is defined at a lower terminal end of a base member 16 that includes a base member externally threaded cylinderical upper end 17 whose axis defines an acute included angle 18 between the base floor 13 and the cylindrical upper end 17. A base member hollow cap 19 of a generally semi-spherical configuration is arranged to receive ballast, such as sand and the like, therewithin to provide for anchoring of the organization to a beach surface. The base member hollow cap 19 includes a hollow cap internally threaded lower end 20 receiving the externally threaded cylindrical upper end 17 therewithin. The hollow cap further includes a plurality of hollow cap hollow leverage body legs 21 projecting laterally of and orthogonally relative to the spring hinge 15 and laterally of and in communication with the hollow cap 19 to further receive ballast therewithin as the cavity of the legs 21 are in communication with the hollow cap 19.

Figure 5:
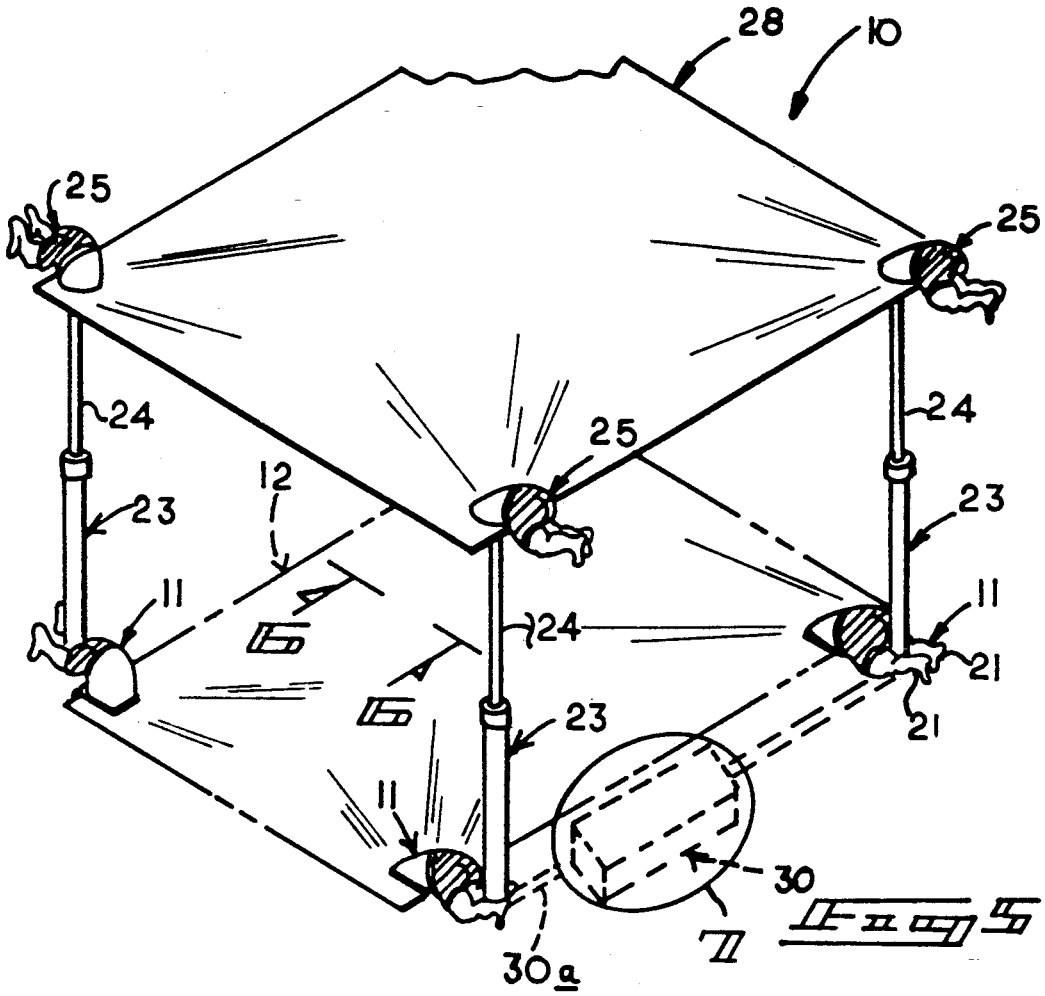
FIG. 5 is an isometric illustration of the instant invention.
Figure 6:
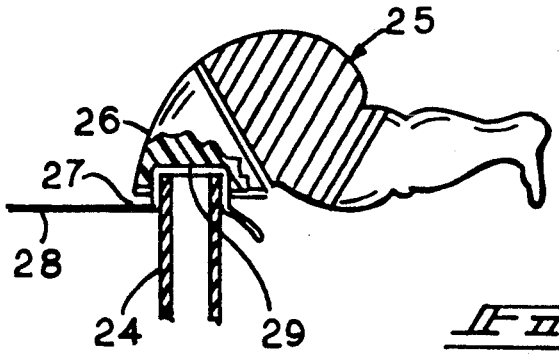
FIG. 6 is an orthographic side view, partially in section, of an extension leg cap utilized by the organization as set forth in FIG. 5.
Figure 7:
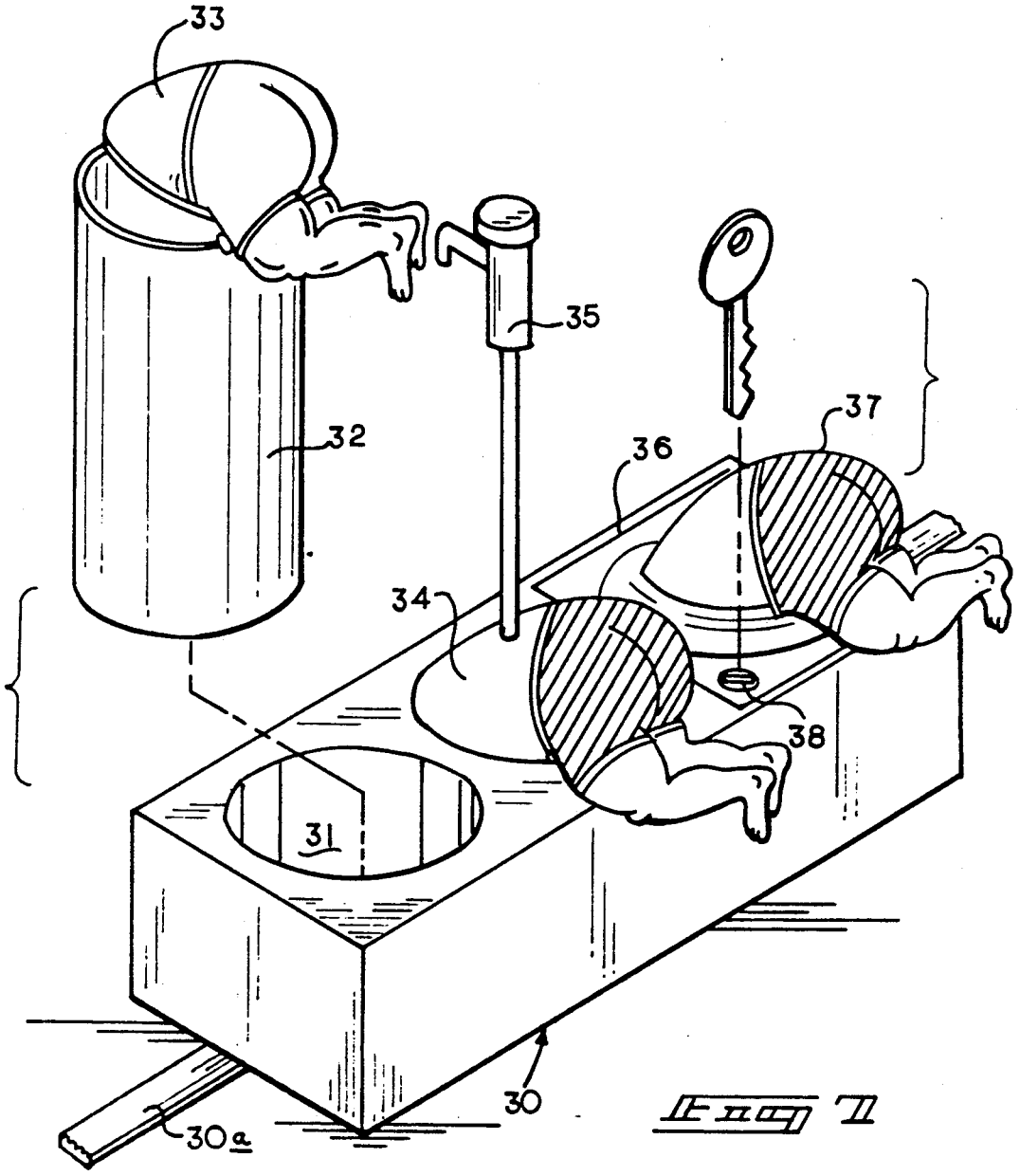
FIG. 7 is an isometric illustration of section 7 as set forth in FIG. 5.

Reference to the FIG. 5 illustrates the legs 21 that are resiliently biased towards one another to receive a telescoping pole member 23 therebetween, that in turn is imbedded within the underlying beach surface. Each telescoping pole member 23 includes an extension leg 24 to permit positioning of a sun screen cover web 28 in a spaced relationship above the blanket web 12 and an extension leg cap 25 including a cap resilient base 26, and a resilient base bottom wall 27. The bottom wall 27 includes a bottom wall extension leg cylindrical receiving cavity 29 to resiliently and securedly receive the upper terminal end of an associated extension leg 24 therewithin capturing the sun screen cover web 28, or more specifically a corner thereof, between the upper terminal end of the extension leg 24 and the extension leg receiving cavity 29.

Further, a dispensing housing 30 is provided integrally mounted to a mounting plate 30 that is mounted in turn between adjacent anchor members 11. At least one or a plurality of dispenser housings 30 may be utilized between adjacent anchor members 11 and preferably fixedly, but in turn may be positioned below an associated anchor member to orient the dispenser housing 30 relative to the blanket web 12. The dispenser housing 30 includes a first cylindrical cavity 31 to be directed through a top wall of the dispenser housing 30 to removably mount a fluid container 32, including a container lid 33 for the containment of a beverage and the like therewithin. A lotion container 34 and associated lotion container pump 35 are mounted into the housing 30 along with a storage compartment 36 that is formed with a storage compartment lid 37 and a lid latch 38 that may be operative through a key member to secure valuables therewithin. The dispenser housing mounting plate 30*a* as illustrated is formed of a generally rigid material in its mounting fixedly to or below adjacent anchor members 11 in use.

As to the manner of usage and operation of the instant invention, the same should be apparent from the above disclosure, and accordingly no further discussion relative to the manner of usage and operation of the instant invention shall be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A beach blanket anchor apparatus in combination with a flexible blanket web, including at least a plurality of anchor members securable to the anchor web, each of the anchor members are arranged in spaced adjacency relative to one another, and wherein each anchor member includes a planar base floor, and a clamp plate, the clamp plate including a spring hinge, the spring hinge mounted to the planar base floor to bias the clamp plate in contiguous communication with the planar base floor to receive the blanket web between the clamp plate and the planar base floor, and the anchor member includes a base member, and the base member is defined by the planar base floor at a lower terminal end of the base member, and the base member includes an externally threaded cylindrical upper end, the cylindrical upper end includes an upper end axis, and the upper end axis defines an acute included angle between the planar base floor and the externally threaded cylindrical upper end, and the base member further including a base member hollow cap, the hollow cap including an internally threaded lower end securable to the externally threaded cylindrical upper end, and the hollow cap further including a plurality of hollow leverage body legs projecting laterally of the hollow cap and oriented orthogonally relative to the spring hinge, wherein the hollow leverage body legs are in communication with the hollow cap to receive ballast material within the hollow leverage body legs and the hollow cap.

2. An apparatus as set forth in claim 1 wherein the hollow leverage body legs are generally biased together, and a telespcoping pole member is positioned between the hollow leverage body legs of each anchor member, and each telescoping pole member includes an extension leg telescopingly mounted within the telescoping pole member, and each extension leg includes an extension leg upper terminal end, and an extension leg cap is arranged for securement to each extension leg upper terminal end.

3. An apparatus as set forth in claim 2 wherein a sun screen cover web is positioned between the extension leg upper terminal end and the cap to secure the sun screen cover web between the extension leg and the extension leg cap.

4. An apparatus as set forth in claim 3 wherein each extension leg cap includes a resilient base, the resilient base including a base bottom wall, the base bottom will including an extension leg cylindrical receiving cavity to receive the extension leg upper terminal end therewithin.

5. An apparatus as set forth in claim 4 wherein the plurality of anchor members includes a dispenser housing mounting plate secured to the plurality of anchor members, and a dispensing housing mounted to the dispensing housing mounting plate, and the dispensing housing including a cylindrical cavity, the cylindrical cavity including a fluid container received within a cylindrical cavity, the fluid container including a fluid container lid mounted to an upper terminal end of the fluid container.

6. An apparatus as set forth in claim 5 wherein the dispenser housing further includes a lotion container, the lotion container including a lotion container pump to project lotion from the lotion container exteriorly thereof, and the dispenser housing further including a storage compartment, the storage compartment including a compartment lid, and the compartment lid including a latch to selectively secure the compartment lid to the dispenser housing.

* * * * *